US008425155B2

(12) United States Patent
Mikx

(10) Patent No.: US 8,425,155 B2
(45) Date of Patent: Apr. 23, 2013

(54) JACKING SYSTEM FOR A LEG OF A JACK-UP PLATFORM

(75) Inventor: Johannes Wilhelmus Jacobus Mikx, Dordrecht (NL)

(73) Assignee: GustoMSC Resources B.V., Schiedam (NL)

( * ) Notice: Subject to any disclaimer, the term of this patent is extended or adjusted under 35 U.S.C. 154(b) by 298 days.

(21) Appl. No.: 12/709,213

(22) Filed: Feb. 19, 2010

(65) Prior Publication Data

US 2010/0215439 A1 Aug. 26, 2010

(30) Foreign Application Priority Data

Feb. 20, 2009 (NL) ..... 2002549

(51) Int. Cl.
*E02B 17/08* (2006.01)

(52) U.S. Cl.
USPC ..... 405/198; 405/196; 405/199

(58) Field of Classification Search ..... 405/196, 405/198, 199, 203, 221
See application file for complete search history.

(56) References Cited

U.S. PATENT DOCUMENTS 4,199,276 A * 4/1980 Molsberger ..... 405/198
2005/0260040 A1* 11/2005 Ingle et al. ..... 405/198

FOREIGN PATENT DOCUMENTS

GB 838627 A 6/1960
WO WO 2009/017399 A1 2/2009

OTHER PUBLICATIONS

Search Report and Written Opinion for Netherlands Application No. NL 2002549 dated Jul. 31, 2009.

* cited by examiner

*Primary Examiner* — John Kreck
*Assistant Examiner* — Benjamin Fiorello
(74) *Attorney, Agent, or Firm* — Leydig, Voit & Mayer, Ltd.

(57) ABSTRACT

A jacking system (4) is described for a leg (3) of a jack-up platform (1). The jacking system comprises at least three independent yokes (7*a*-7*d*). Each independent yoke is connected to a jack-up structure by at least one vertically arranged double acting actuator (8*a*-8*d*') and is equipped with a leg engaging mechanism such as a horizontally arranged movable locking pin (9*a*-9*d*), which is configured to engage or to disengage with a hole of the jack-up leg, in order to transfer a load (L) from the jack-up platform (1) to the leg (3), including a controller configured to operate the yokes (7*a*-7*d*) in a way that the leg (3) is moved by all the at least three yokes (7*a*-7*d*) in an alternating mode, such that at any moment in time during operation all but one of the at least three yokes (7*a*-7*d*) take the load (L) via the associated engaging mechanism, while the remaining yoke of the at least three yokes (7*a*-7*d*) makes a return stroke with its engagement mechanism in a disengaged position.

10 Claims, 8 Drawing Sheets

JACKING SYSTEM FOR A LEG OF A JACK-UP PLATFORM

CROSS-REFERENCE TO RELATED APPLICATION

This application claims the priority benefit of Mikx, Application Serial No. NL 2002549 filed on Feb. 20, 2009, the contents of which are incorporated herein by reference in their entirety, including any references therein.

FIELD OF THE INVENTION

The invention relates to jack-up platforms. More particularly the invention relates to a jacking system applied on a jack-up platform for near shore and offshore installation, drilling, maintenance, deployment and for decommissioning of offshore structures such as gas and oil platforms, subsea structures, wind energy generating structures and/or other offshore structures.

BACKGROUND

Generally, the jacking systems of jack-up platforms consist of either:

(1) continuous system like rack and pinion systems or winch and wire systems, or (2) discontinuous systems working with actuators such as hydraulic cylinders in mainly two modes.

In the first mode of the two modes, the load of the leg is carried by the hydraulic cylinder, and in the second mode the leg is locked to the platform while the hydraulic cylinders make their return stroke.

The jack-up platform is brought to its offshore location afloat. At the offshore location the jack-up platform is able to rise out of the water and stand above the waves. The jacking system provides a connection between the jack-up leg and the jack-up platform. The jacking system is able to lower and raise the legs. When the legs are in contact with the seafloor, the jacking system will eventually raise and lower the platform.

A discontinuous jacking system with hydraulic cylinders is generally more economical than a continuous system like rack and pinion and winch and wire system. On the other hand, due to the intermittent operation, the system is slow.

SUMMARY OF THE INVENTION

The disclosure herein is directed to a jacking system and a method of jacking that is faster while maintaining the advantages of known systems.

A first aspect of the disclosure relates to a jacking system for a leg of a jack-up platform, comprising at least three independent yokes, wherein each independent yoke is connected to a jack-up structure by at least one vertically arranged double acting actuator and is equipped with a leg engaging mechanism such as a horizontally arranged movable locking pin. The engaging mechanism is configured to engage or to disengage with a hole of the jack-up leg, in order to transfer a load from the jack-up platform to the leg. The system further includes a controller configured to operate the yokes in a way that the leg is moved by all the at least three yokes in an alternating mode, such that at any moment in time during operation all but one of the at least three yokes take the load via the associated engaging mechanism. The remaining yoke of the at least three yokes makes a return stroke with its engagement mechanism in a disengaged position.

The disclosure is also directed to a method for moving a leg of a jack up platform comprising the steps of providing a jacking system described herein and associating the jacking system with a leg of a jack up platform. The method furthermore includes disengaging an engagement mechanism of a remaining yoke from a hole of the leg while maintaining the engagement of the yokes that are load bearing. The method also includes actuating the actuators of the engaged yokes, while returning the first disengaged yoke in its original position, and re-engaging the first yoke and disengaging a second yoke. The described steps are repeated for each consecutive yoke, one at a time, to move the leg in an upright direction.

Further advantageous aspects of the disclosed jack system and method can be found in the recited claims.

BRIEF DESCRIPTION OF THE DRAWINGS

For a better understanding, embodiments of the jacking system will be further elucidated by the following Figures, wherein.

In the figures and the description the same or corresponding parts will have identical or similar reference signs. The embodiments shown should not be understood as limiting the invention in any way or form.

DETAILED DESCRIPTION OF THE DRAWINGS

Figure 1:
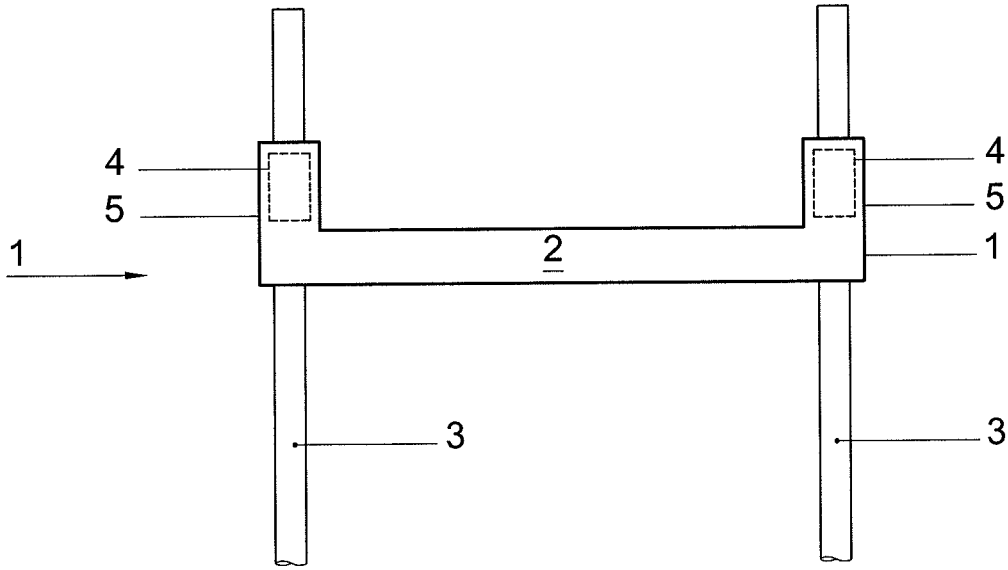
FIG. 1 is a schematic side view of a jack up platform.
Figure 2:
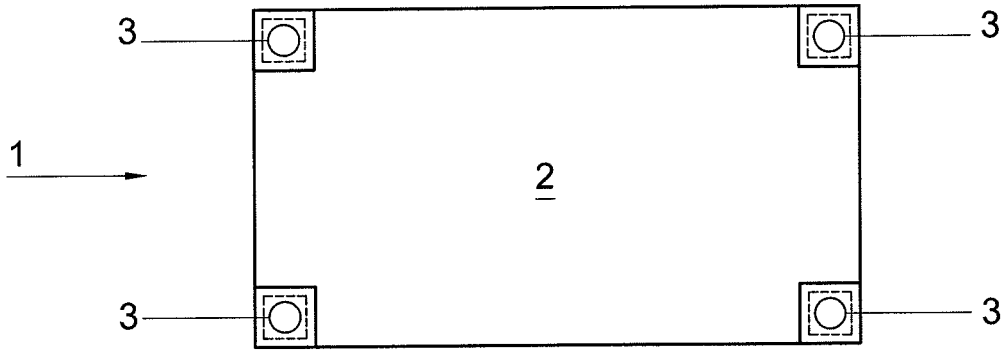
FIG. 2 is a schematic top view of a jack up platform.

FIGS. 1 and 2 represent, respectively, a side and a top view of a typical jack up platform 1, wherein a platform structure 2 can be lowered and raised relative to the legs 3. The structure 2 of the platform can be typically a barge or a pontoon. In FIGS. 1 and 2, the platform includes 4 legs. Each of the legs 3 is connected to the deck of the platform by means of a jacking system 4 that is incorporated in a jack up structure such as a jack-house 5. The jack-house 5 is in general affixed to the platform structure 2 and transfers the loads of the structure 2 and eventual additional loads exerted to the structure 2 to the seabed through the legs 3. Each leg is moved by a jacking system 4 which is housed in a jack-house 5. The jack-house 5 is normally a plate construction and it may be part of the platform structure 2.

Although four of the legs 3 are shown, more or less of the legs 3 might be similarly applied. Even a platform with one leg 3 can include the jacking system 4 described herein.

Figure 3:
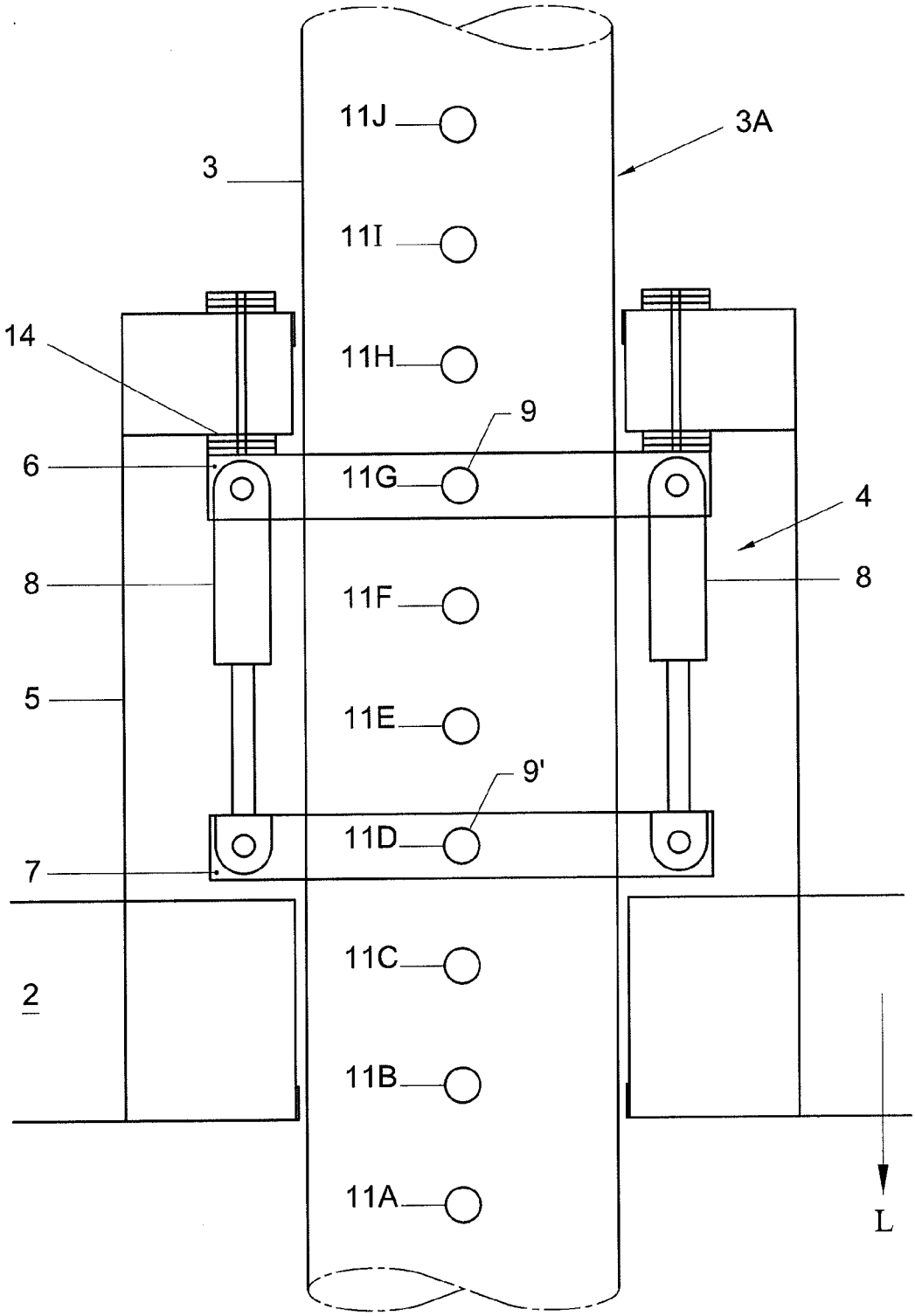
PRIOR ART Fig. 3
FIG. 3 is a partly worked open schematic side view of a jack up system as known in the art.

FIG. 3 represents a partly worked open side view of a jacking system 4 as known in the art. FIG. 3 depicts a typical discontinuous jacking system, wherein vertical movement of the legs 3 relative to the platform structure 2 is performed in an intermittent motion.

The jacking system 4 depicted in FIG. 3 consists of basically two yokes 6, 7 (an upper 6 and a lower 7 yoke) connected by two hydraulic cylinders 8. Each yoke 6,7 is equipped with a locking pin 9, 9' which can be engaged in a hole 11*a*-11*j* in the leg wall 3*a* to transfer the vertical load L. In FIG. 3 a cross section of the jack-house 5 is shown in which an arrangement with a fixed upper yoke 6 and a moveable lower yoke 7 is positioned. The lower yoke 7 is moved by two hydraulic cylinders 8. The locking pin 9 and 9' are positioned in the centre of the yokes 6 and 7 respectively. The locking pins 9 and 9' are actuated by separate small hydraulic cylinders 10*a*-10*d*.

Figure 4:
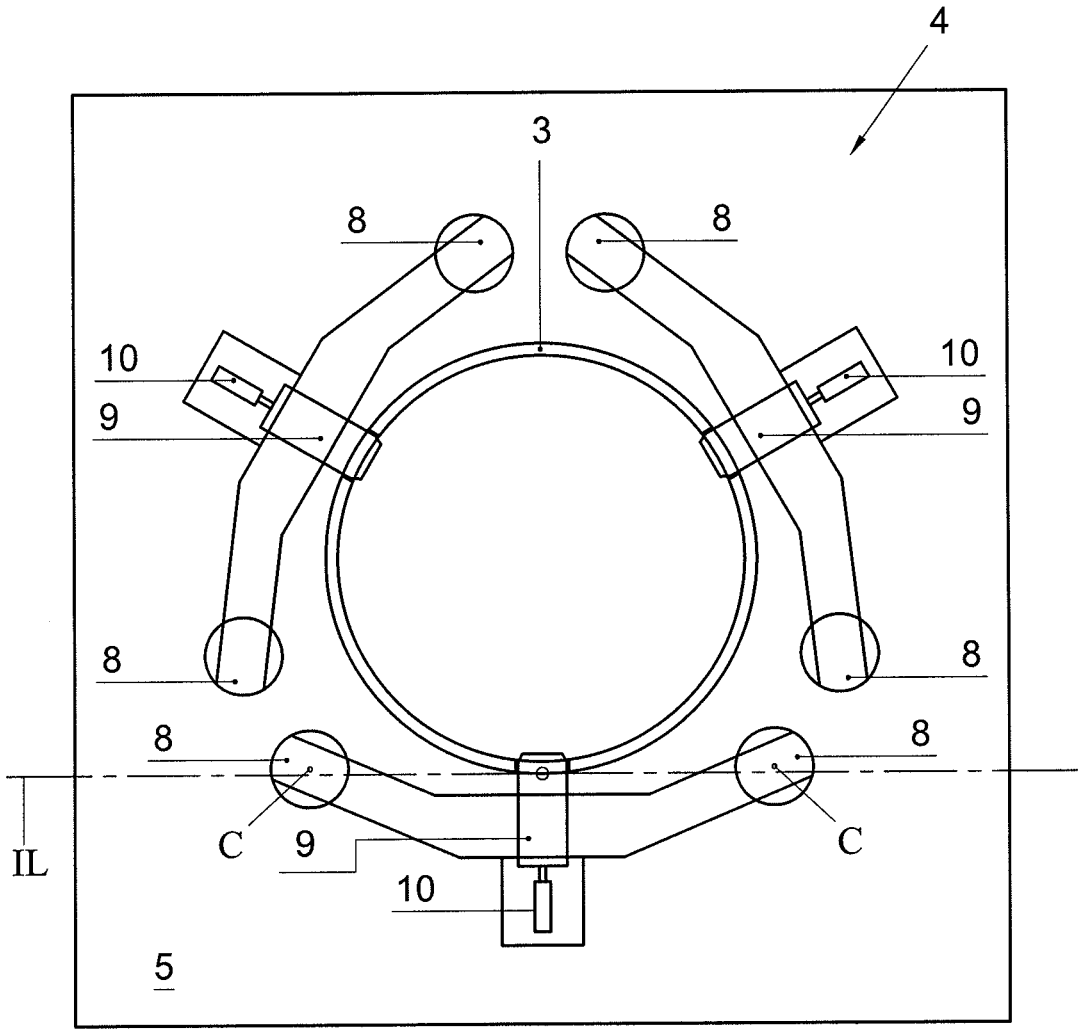
PRIOR ART Fig. 4
FIG. 4 is a schematic top view of a jack up system as known in the art.

In FIG. 4, the jack-house 5 with the jacking system 4 is depicted in a cross sectional top view. In FIG. 4, an arrangement with 3 upper yokes 6 and 3 lower yokes 7, and thus 6 hydraulic cylinders 8, is shown.

Each yoke 6, 7 in FIG. 4 is in balance, meaning that an imaginary straight line, such as line IL, runs through the centers of the two cylinders 8 and the center CK of the contact area of the locking pin 9 inside one of the leg holes 11.

Normally the three yokes work in parallel.

In the jacking modes:

- The locking pin 9' of lower yoke 7 is brought in a leg engaging position by cylinder 10'.
- The locking pin 9 of the upper yoke 6 is brought in a disengaged position by cylinder 10.
- The cylinders 8 push the leg 3 downwards until the end of the stroke of the cylinder, being equal to pitch, i.e. the vertical distance between the holes 11*a*-11*b*.
- The locking pin 9 of the upper yoke 6 is brought in a leg engaging position by cylinder 10, and the upper yoke 6 takes over the load.
- The locking pin 9' of the lower yoke 7 is brought in a disengaged position, and the cylinders 8 make a return stroke. During this return stroke the legs 3 are not moving with respect to the platform structure 2.

Because of the return stroke, the effective jacking speed of one individual leg is approx 60% to 70% of the nominal cylinder speed during jacking.

The installed hydraulic power (including motor, pump valves, piping etc) needed for jacking is designed for the nominal cylinder velocity. During the return stroke, the platform structure 2 is in rest and only reduced power is needed for the return speed.

Each of the jacking systems 4 follows the same sequence of motions. However, when the seafloor is uneven or when the leg foot penetrations into the seafloor are uneven, the legs 3 might have a different position relative to the platform structure 2.

In order not to twist the platform 1 to an unacceptable level and in order to ensure an even load in each of the legs 3, it might be necessary to stop all jacking systems 4 when one of the systems 4 makes a return stroke.

Due to this phenomenon, the effective jacking speed might be as low as half the normal jacking speed of an independent leg 3.

The load capacity of a jacking system 4 of a jack-up leg 3 is designed for two main conditions:

- elevating (mainly static)
- pre-loading/storm survival (static plus dynamic)

During the elevating condition, the platform structure 2 is lifted out of the water. The jacking systems 4 of all legs 3 together should carry the weight of the platform structure 2 including some system friction.

During the elevating operation, the weather condition of waves, current and wind are fair. The environmental loads on the platform 1 are normally relatively small.

During the storm survival conditions the jack-up platform 1 stands safe above the waves. The platform 1 is loaded only by wind. The legs 3 are loaded by wind, current and waves. The environmental loads result in an extra vertical load on the legs 3.

In order to ensure that the bearing capacity of the soil at the leg tip is sufficient, the expected vertical storm survival load plus some allowance is applied once during pre-loading. Pre-loading is therefore a standard part of the installation procedure of the platform. Accordingly, the pre-load of a jacking system 4 is always higher than the nominal jacking load. Thus the cylinders 8 of a jacking system 4 as described before should be designed and certified for the pre-load condition. Consequently, during normal jacking, the capacity of the cylinders is only partly used.

The illustrative embodiments of a jacking system disclosed herein include a faster jacking system and a more economical use of the hydraulic cylinder capacity.

The illustrative embodiments are described with reference to FIGS. 5, 6 and 7.

Figure 5:
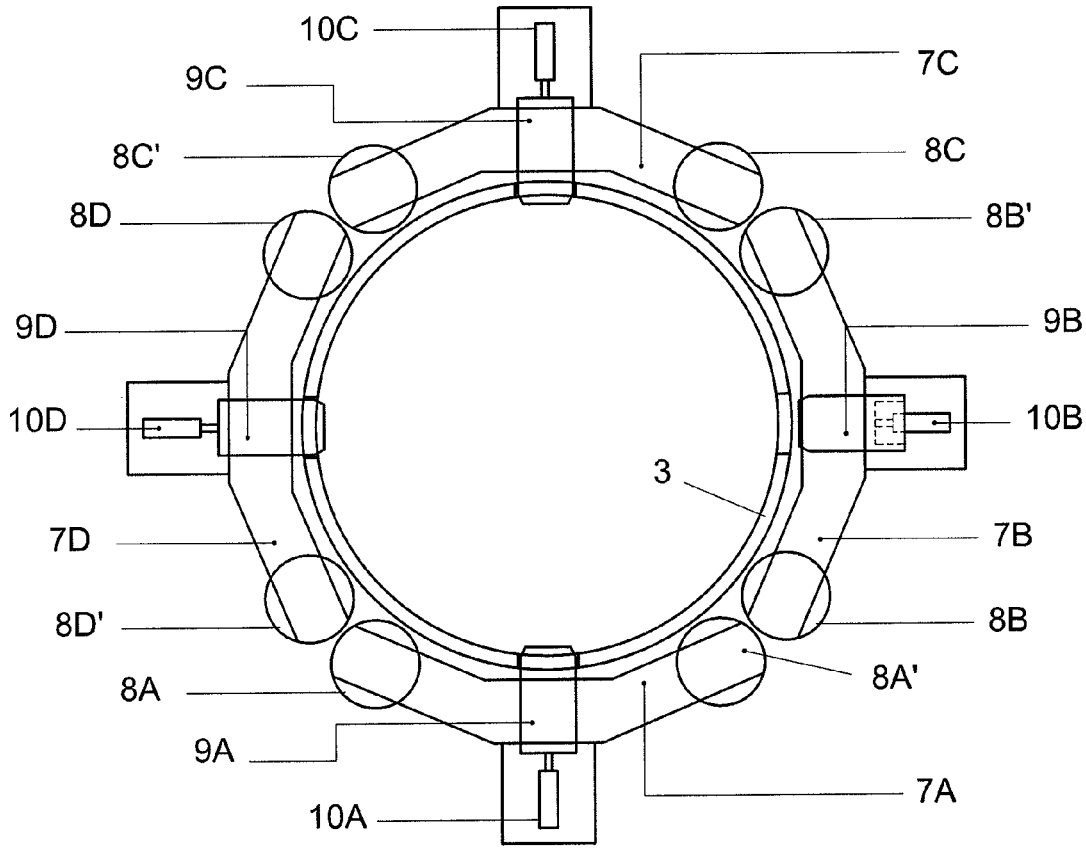
FIG. 5 is a schematic top view of a jack up system according to a first embodiment of the invention.

In FIG. 5, the jacking system 4 includes a circular (cross-section) leg 3 with four independent yokes 7*a*, 7*b*, 7*c* and 7*d*. Each independent yoke 7*a*, 7*b*, 7*c* and 7*d* is operated by two hydraulic cylinders 8*a*, 8*a'*, 8*b*, 8*b'*, 8*c*, 8*c'*, 8*d*, 8*d'* respectively. Each yoke 7*a*, 7*b*, 7*c* and 7*d* is equipped with a locking pin 9*a*, 9*b*, 9*c*, 9*d* which is operated (extended/retracted) by a small hydraulic cylinder 10*a*, 10*b*, 10*c* and 10*d* respectively.

During jacking, three out of four yokes 7*a*, 7*b*, and 7*c* are in engagement with the leg 3 by means of the locking pins 10*a*, 10*b* and 10*c* respectively. The jacking load is carried by these three yokes 7*a*, 7*b* and 7*c*. During jacking, the fourth yoke 7*d* is disengaged and makes a return stroke at a speed S2 higher than the jacking speed S1 (see, FIG. 7).

Figure 6:
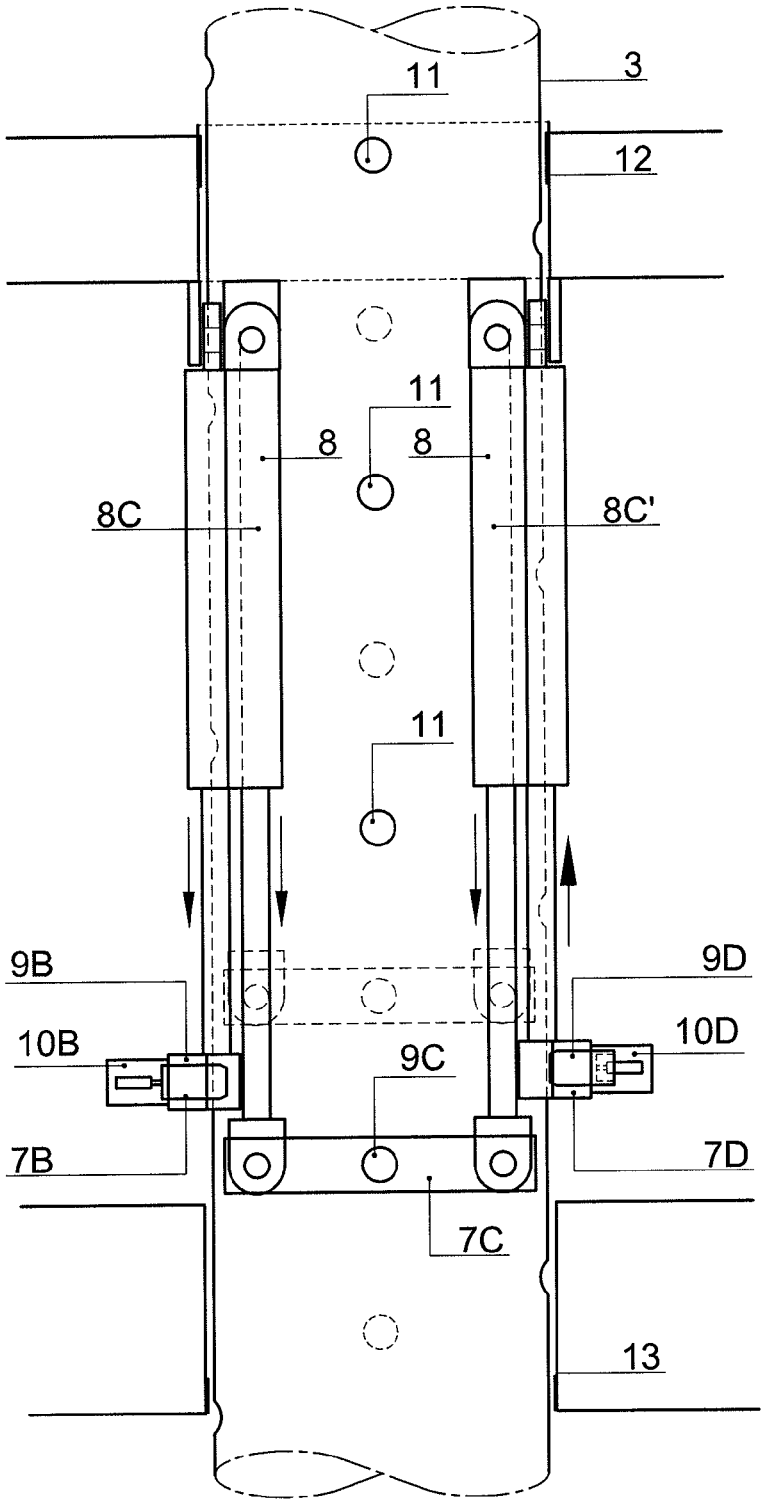
FIG. 6 is a partly worked open side view of a further embodiment of the invention.
Figure 7:
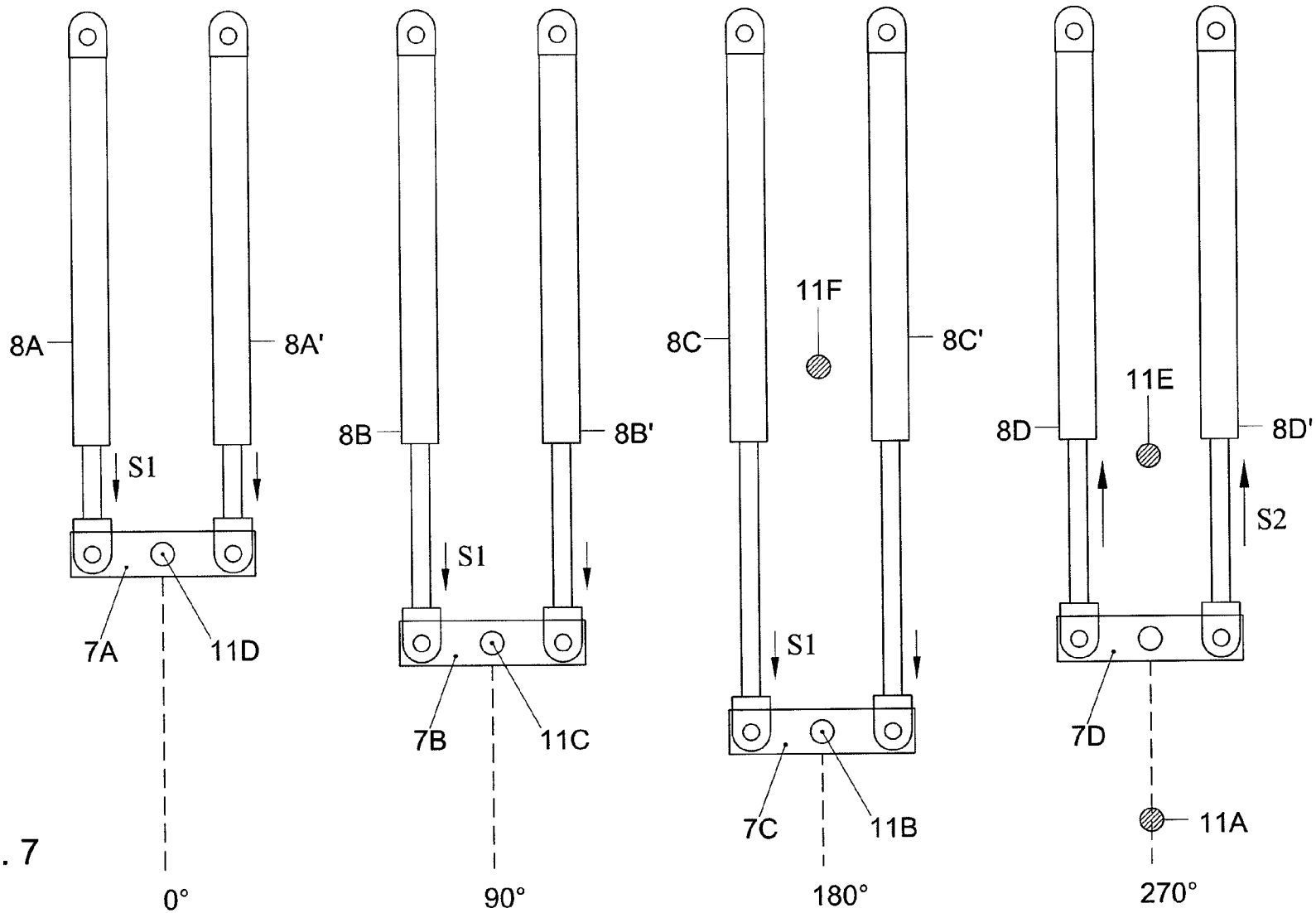
FIG. 7 is a schematic rolled out view of the jack up system according to a further embodiment of the invention.

In FIG. 7, a schematic rolled out projection of the jacking system as presented in FIG. 6 is given. In FIG. 7, the different positions of the hydraulic cylinders 8*a*-8*d'* and the yokes 7*a*-7*d* are depicted one next to each other.

In FIGS. 6 and 7, the various yokes 7*a*, 7*b*, 7*c* and 7*d* are in different positions. For example:

- The first yoke 7*a* might be at ¼ of the cylinder stroke.
- The second yoke 7*b* might be at ¼ of the cylinder stroke.
- The third yoke 7*c* might be at ¾ of the cylinder stroke.
- The fourth yoke 7*d* is then approximately half way the return stroke.

Referring to FIG. 7, the return yoke 7*d* can automatically engage when it reaches the hole 11*e* in the leg 3. When the locking pin 9*d* engages hole 11*e*, the jacking stops and the furthest extended yoke 7*c* can be disengaged from hole 11*b*. Then the jacking may continue, wherein now the yokes 7*a*, 7*b* and 7*d* are bearing load, and whereas yoke 7*c* is returning to its retracted state.

By this way of alternating of the returning yoke, the stops are limited to only a few seconds.

The eight jacking cylinders 8*a*-8*d'* are, by way of example, identical and are suspended at the same level from the inside roof 14 of the jack-house 5.

The different positions of the yokes 7*a*-7*d* are possible because the holes 11*a*-11*j* in the leg 3 are on different vertical positions in a helical or spiral type pattern. A possible arrangement of the leg holes and the yokes is shown in FIGS. 6 and 7.

During pre-loading and during storm survival conditions, all four yokes 7*a*-7*d* are engaged and the leg load is distributed over eight cylinders 8*a*-8*d'*.

The arrangement described above exhibits the advantages of potentially obtaining a high jacking speed while at the same time the installed hydraulic power can be fully used. Furthermore, an effective use of cylinder capacity in jacking mode and survival mode can be obtained. Beside these advantages, for the system described above, a reduced number of parts is needed, for instance, because no upper yokes 6 are needed.

The above description is based on a jacking system 4 with a closed circular leg 3 and four jacking yokes 7*a*-7*d*, including 8 cylinders 8*a*-8*d*'. The same principle can be applied in a square or triangular truss type leg or on any closed cylindrical leg with a triangular, square, hexagonal or octagonal cross section.

Although in the description and the Figures each yoke 7*a*-7*d* includes one locking pin 9*a*-9*d*, the same principle also applies to a system with two or more locking pins in each yoke. Similarly, although each yoke 7*a*-7*d* includes two cylinders 8*a*-8*d*', each yoke can also be equipped with more than two cylinders such as, for example, four cylinders per yoke.

Besides the above described jacking sequence of the individual yokes 7*a*-7*d*, the jacking system 4 can also be operated in a continuous way. The locking pin 10 of the yoke 7 in the return stroke can, for instance, engage the leg hole 11 automatically as soon as it reaches the appropriate hole 11*a*-11*j* in the leg 3.

When the pin 9*a*-9*d* passes the leg hole 11*a*-11*j*, it is pressed into the hole and the yoke 7*a*-7*d* automatically follows the leg at low pressure oil. When one of the other yokes reaches the end of its cylinder stroke, the jacking system 4 stops in order to disengage the locking pin. This action only takes a few seconds.

During disengaging the locking pin, the jacking system 4 of the other legs 3 continue their movement. The uneven jacking speed of the various legs 3 might cause a small twist deformation of the platform, which is acceptable. Only when the disengagement takes longer than a few seconds (for whatever reason), should the other jacking systems stop.

By the arrangement of the jacking system 4 as described above, the effective average jacking speed can be almost (e.g., 95%) as high as the cylinder speed.

The jacking system can be made continuous and at constant speed by adding a control mechanism described below.

When the yoke with the most extended cylinders reaches the end of the stroke, the speed of that yoke will be slightly increased relative to the other yokes in a way that the locking pin is unloaded and can be disengaged. As soon as the locking pin is disengaged, the speed of the cylinders of that yoke can be reversed for the return stroke.

A hydraulic piping system connects the various parts of the jacking system including hydraulic cylinders, valves, pumps and reservoirs. The piping system is arranged in a way that during jacking, high pressure hydraulic oil is pumped to the bottom side of three out of four pairs of cylinders.

The low pressure ring side of the three pairs of pushing cylinders is connected to the ring side of the single pair of cylinders in the return mode.

The ring side flow of three pairs of active cylinders is sufficient to bring the pairs of cylinders performing the return stroke back in the start position with some time allowances. In this way no extra pump is needed for the return stroke.

During jacking with three out of four yokes, the total jacking force is, for example, applied outside the centre of the leg at approximately ⅙ of the leg diameter.

This eccentric jacking force causes a moment in the jack-up leg. This moment can be counteracted by the upper 12 and lower 13 leg guide, as is shown in FIG. 6.

An exemplary distance between the leg guides 12 and 13 is four times the leg diameter. The horizontal reaction force at each of the guides can be $\frac{1}{6}\times\frac{1}{4}=\frac{1}{24}$ of the jacking force.

A friction coefficient is conservatively estimated at 0.3. The vertical friction force is then calculated at $\frac{1}{24}\times 2\times 0.3=0.025\times$jacking force. This extra friction force of approx 2.5% is acceptable.

In order to prevent rotation of the leg 3 relative to the platform structure 2, a rotation prevention can be installed. Providing the rotation prevention is, for example, advantageous when the legs have a circular cross section.

External forces and moments may cause rotation of the leg around its vertical axis. The jack-up leg should be locked against this rotation in order to ensure that alignment of the locking pins and corresponding holes in the jack-up leg is correct. The illustrated embodiments include locking against rotation. The locking is ensured by static vertical guidance pillars inside the jack-house and guidance shoes on the yokes 7*a*-7*d*.

Figure 8:
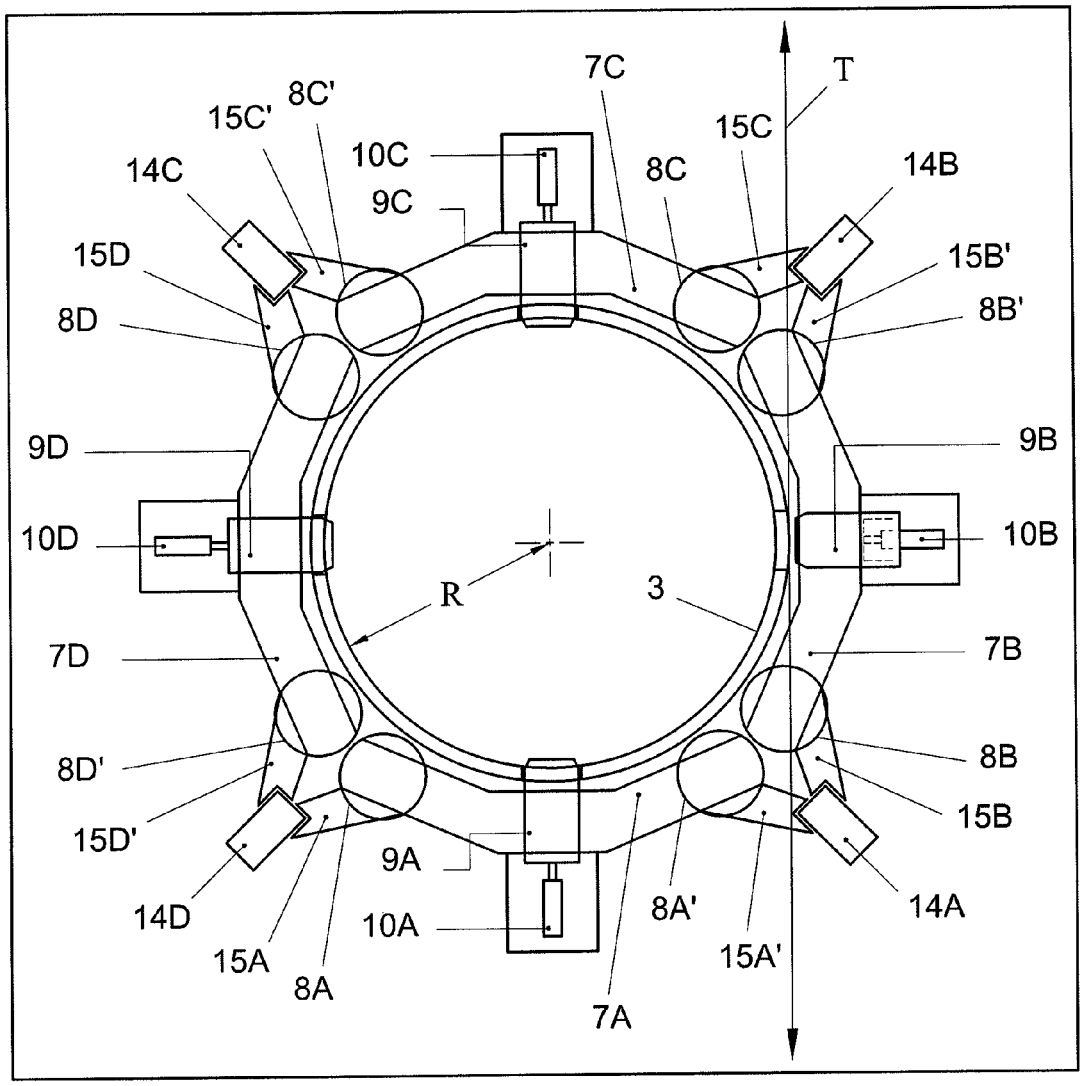
FIG. 8 is a schematic top view of a jack up system according to a further embodiment of the invention.

In FIG. 8, in a further embodiment, four guidance pillars 14*a*, 14*b*, 14*c*, 14*d* are provided. The pillar 14*a* can slide between the shoes 15*a*' and 15*b*, the pillar 14*b* can slide between the shoes 15*b*' and 15*c*, the pillar 14*c* can slide between the shoes 15*c*' and 15*d*, and finally the pillar 14*d* can slide between the shoes 15*a* and 15*d*'. It is potentially advantageous to have two guidance pillars 14*a*-14*d* per yoke 7*a*-7*d* and to have two shoes 15*a*-15*d*' on each pillar 14*a*-14*d*. The guidance pillars 14*a*-14*d* for the several yokes 7*a*-7*d*, can be combined in a way that the number of guidance pillars 14*a*-14*d* is equal to the number of yokes 7*a*-7*d*, as depicted in FIG. 8.

Figure 9:
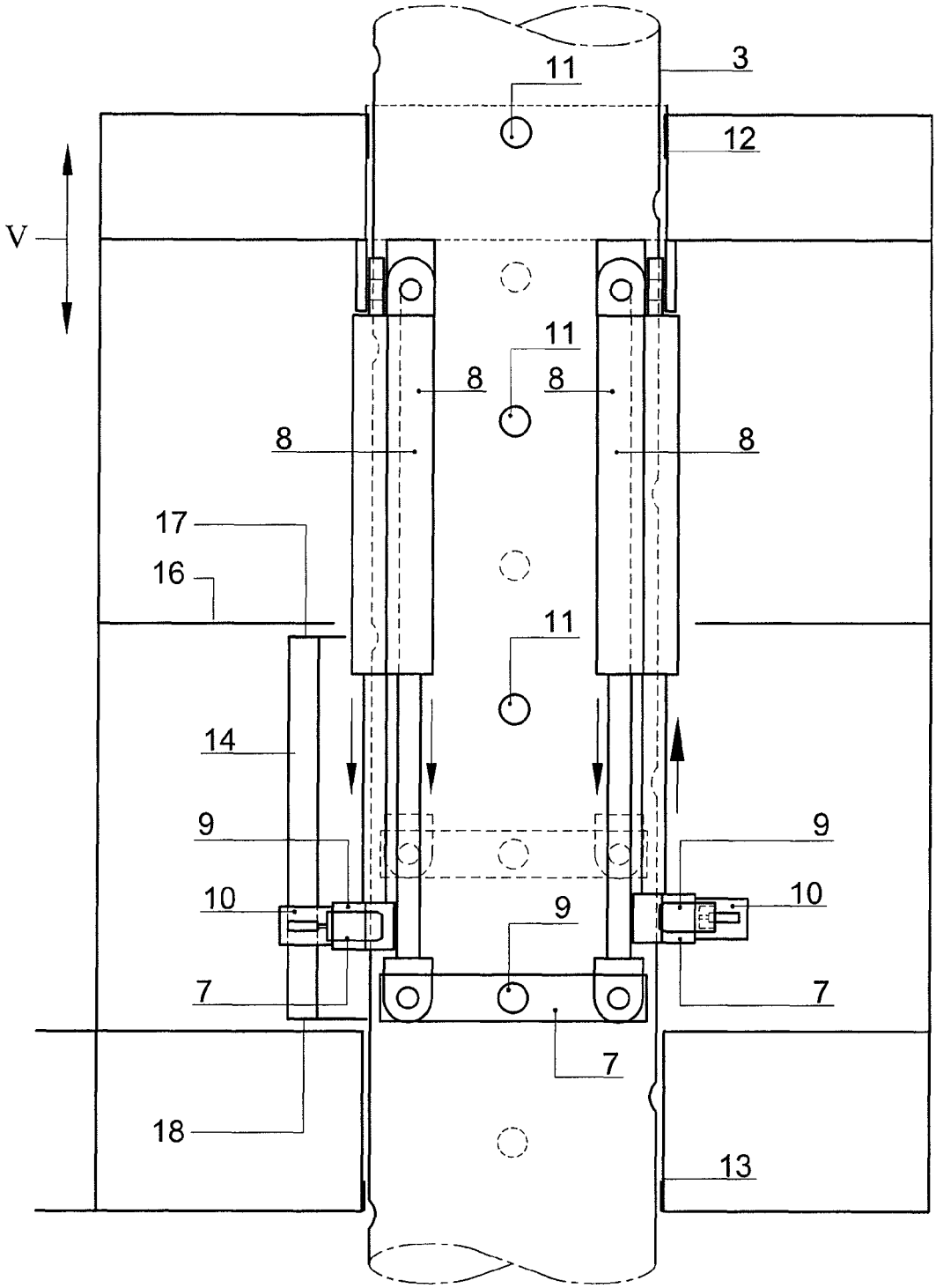
FIG. 9 is schematic partly cut open side view of the further embodiment presented in FIG. 8.

The vertical guidance pillars 14*a*-14*d* are arranged over a height slightly larger than the stroke of the yokes 7*a*-7*d* (e.g., between a tweendeck 16 in the jack-house 5 and the maindeck of the platform 1 in FIG. 9).

The guidance pillars 14*a*-14*d* are fixed at an upper and a lower end to the tweendeck 16 in the jack-house 5 and to the maindeck.

The system of yokes 7*a*-7*d* and locking pins 9*a*-9*d* requires strict tolerances. Very good tolerances are reached by the system described herein below. In order to follow the horizontal deflection of the leg, the guidance pillars 14*a*-14*d* are horizontally guided by the leg 3. This is arranged by an upper ring 17 at tweendeck level and a lower ring 18 just above the maindeck level.

The guidance pillars 14*a*-14*d* and the rings 17 and 18 are fixed to each other. The inside of the rings 17 and 18 is guided by the leg 3 having a small tolerance. The construction of pillars 14*a*-14*d* and rings 17 and 18 is connected to the maindeck and the tweendeck 16 in a way that it is supported in a vertical V and a tangential direction T, but is free in radial direction R.

The upper ring 17 is guided by the leg 3 by means of shoes 15*a*-15*d*' in between the cylinders 8*a*-8*d*'. The lower ring 18 is arranged between the maindeck and the lowest position of yokes 7*a*-7*d*.

In the jacking systems described above, the cylinders are delivering the jacking force in a pushing mode, when carrying the platform. Normally this mode is most advantageous because the cylinder provides more force at the same hydraulic pressure than in a pulling mode.

However, in some arrangements, there is a good reason to apply the pulling mode instead. The embodiments of invention contemplate using either one or both the pushing mode and the pulling mode.

In any illustrative/exemplary embodiment of the invention as described above, numerous adaptations and modifications are possible. Although four yokes 7 per leg 3 are described above, in a similar fashion three yokes could be applied. In the case that three yokes are applied, each time two yokes are load bearing, the third yoke is in a returning motion. In this case again the idle sides of the load bearing cylinders are connected to the returning side of the returning cylinder, forcing this to return to its original position.

Also more than four yokes can be applied in a similar alternating sequence.

Within the hydraulic piping system, each cylinder assembly is dedicated to an individual yoke, which can be performing a repetitive or alternating sequence. In such a hydraulic system, rotary hydraulic valves can be applied, for example, for both the working piston side and the idle piston side of the cylinders.

Throughout the description the actuators are described as hydraulic cylinders. These actuators can also be other mechanical, electrical or electromechanical actuators, such as, for example, linear motors.

These and other adaptations and modifications are possible without departing from the spirit and scope of the invention as defined in the claims.

What is claimed is:

1. A jacking system for a leg of a jack-up platform, comprising:

at least three independent yokes, each yoke being connected to a jack-up structure by at least one vertically arranged double acting actuator and being equipped with a leg engaging mechanism, which is configured to engage and disengage with a hole of the jack-up leg, in order to transfer a load from the jack-up platform to the leg; and an anti-rotation provision configured to prevent rotation of the leg relative to the platform, wherein said anti-rotation provision includes:

a plurality of guidance shoes, at least one of the guidance shoes being provided on each of the three independent yokes; and a plurality of vertical guidance pillars, the vertical guidance pillars being fixed together by rings surrounding the leg, and arranged for slidingly guiding the three independent yokes via the plurality of guidance shoes, wherein the plurality of vertical guidance pillars and rings are connected to the platform such that a sub-assembly including the vertical guidance pillars and rings is supported by the platform in a vertical direction and a tangential direction of the leg, but freely moveable in a radial direction with respect to a transverse cross-section of the leg, to prevent rotation of the leg when engaged by a leg engagement mechanism and permit the vertical guidance pillars to be horizontally guided by the leg.

2. The jacking system according to claim 1, wherein the alternating mode involves a yoke of the at least three yokes that has made a return stroke, while the other yokes arc load bearing, is controlled such that a next return stroke of that yoke occurs only after each of the other yokes also have made a return stroke.

3. The jacking system according to claim 1, wherein all the leg engaging mechanisms are engaged when the jacking system is not in operating mode.

4. The jacking system according to claim 1, wherein the actuators are operated in a way that each leg can be moved at a constant speed.

5. The jacking system according to claim 1, wherein the actuators are chosen from the group consisting of:

air cylinders, electric actuators, and hydraulic cylinders.

6. The jacking system according to claim 1, where the return stroke of the at least one actuator of the remaining yoke is activated by outflow of the actuators of the yokes that are currently load bearing.

7. The jacking system according to claim 1, wherein the holes in the leg are arranged in a helical or spiral pattern around the leg.

8. The jacking system of claim 1 wherein the leg engaging mechanism comprises a horizontally arranged movable locking pin.

9. The jacking system of claim 1 further comprising:

a controller configured to operate the yokes in a way that the leg is moved by all the at least three yokes in an alternating mode, such that at any moment in time during operation all but one of the at least three yokes take the load via the associated leg engaging mechanism, while the remaining yoke of the at least three yokes makes a return stroke with the leg engaging mechanism of the remaining yoke in a disengaged position.

10. A method for moving a leg of a jack up platform comprising the steps of:

providing a jacking system for a leg of a jack-up platform, the jacking system comprising:

at least three independent yokes, each yoke being connected to a jack-up structure by at least one vertically arranged double acting actuator and being equipped with a leg engaging mechanism, which is configured to engage and disengage with a hole of the jack-up leg, in order to transfer a load from the jack-up platform to the leg, an anti-rotation provision configured to prevent rotation of the leg relative to the platform, wherein said anti-rotation provision includes:

a plurality of guidance shoes, at least one of the guidance shoes being provided on each of the three independent yokes, and a plurality of vertical guidance pillars, the vertical guidance pillars being fixed together by rings surrounding the leg, and arranged for slidingly guiding the three independent yokes via the plurality of guidance shoes, wherein the plurality of vertical guidance pillars and rims are connected to the platform such that a sub-assembly including the vertical guidance pillars and rings is supported by the platform in a vertical direction and a tangential direction of the leg, but freely moveable in a radial direction with respect to a transverse cross-section of the leg, to prevent rotation of the leg when engaged by a leg engagement mechanism and permit the vertical guidance pillars to be horizontally guided by the leg, and a controller configured to operate the yokes in a way that the leg is moved by all the at least three yokes in an alternating mode, such that at any moment in time during operation all but one of the at least three yokes take the load via the associated leg engaging mechanism, while the remaining yoke of the at least three yokes makes a return stroke with the leg engaging mechanism of the remaining yoke in a disengaged position;

associating the jacking system with a leg of a jack up platform;

disengaging an engagement mechanism of a remaining yoke from a hole of the leg while maintaining the engagement of the yokes that are load bearing;

actuating the actuators of the engaged yokes, while returning the first disengaged yoke in its original position;

re-engaging the first yoke and disengaging a second yoke; and repeating the disengaging, actuating and re-engaging steps for each consecutive yoke, one at a time, thus moving the leg in an upright direction.

* * * * *